US007483664B2

(12) United States Patent
Roof

(10) Patent No.: US 7,483,664 B2
(45) Date of Patent: Jan. 27, 2009

(54) FUSING APPARATUS HAVING A SEGMENTED EXTERNAL HEATER

(75) Inventor: Bryan J Roof, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 247 days.

(21) Appl. No.: 11/538,581

(22) Filed: Oct. 4, 2006

(65) Prior Publication Data

US 2008/0085139 A1 Apr. 10, 2008

(51) Int. Cl.
*G03G 15/20* (2006.01)

(52) U.S. Cl. ..... 399/328

(58) Field of Classification Search ..... 399/38, 399/67, 69, 107, 122, 320, 328, 329, 333; 216/219, 619

See application file for complete search history.

(56) References Cited

U.S. PATENT DOCUMENTS 6,407,366 B2 6/2002 Yoshimura
6,734,397 B2 5/2004 Kato et al.
6,882,804 B2 * 4/2005 Eskey ..... 399/45
6,895,207 B2 5/2005 Kataoka et al.
7,027,749 B2 * 4/2006 Kamei ..... 399/69
7,283,145 B2 * 10/2007 Kato et al. ..... 347/156
7,373,094 B2 * 5/2008 Kishi et al. ..... 399/69

OTHER PUBLICATIONS

Bryan J. Roof et al., U.S. Appl. No. 11/398,147, filed Apr. 5, 2006, entitled "Fusing Apparatus".

* cited by examiner

*Primary Examiner*—Hoan H Tran
(74) *Attorney, Agent, or Firm*—Tallam I. Nguti

(57) ABSTRACT

A fusing apparatus having a segmented external heater is provided. The fusing apparatus includes a rotatable pressure roller, a rotatable heated fusing member having an external surface forming a fusing nip with the pressure roller, and a rotatable segmented external heater mounted in heating nip contact with the external surface of the fusing member for heating the external surface of the fusing member, the rotatable segmented external heater having (a) an endless rotatable shell defining an interior surface and an exterior surface, a first end, a second end, and an axis of rotation; (b) a plural number of heating elements each having an end-to-end length and being arranged end-to-end in series and parallel to the axis of rotation; and (c) a controller connected to the plural number of heating elements and to the rotatable heated fusing member controlling the temperature of the external surface the fusing member.

20 Claims, 5 Drawing Sheets

FUSING APPARATUS HAVING A SEGMENTED EXTERNAL HEATER

CROSS-REFERENCE TO RELATED APPLICATIONS

Cross-reference and incorporation by reference is made to a co-pending commonly assigned application, U.S. Application. No. 11/398,147, filed Apr. 5, 2006, by Bryan J. Roof and Gerald A. Domoto, entitled "FUSING APPARATUS,".

The present invention relates to an electrostatographic reproducing machine and, more particularly, to such a machine having a fusing apparatus including a segmented external heater.

BACKGROUND OF THE DISCLOSURE

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

Typically, a fuser apparatus of the type provides a combination of heat and pressure to fix the toner image on the paper. The basic architecture of a fuser apparatus is well known. Essentially, it comprises a pressure roll that forms a fusing nip against a rotatable heated that is heated internally or externally as disclosed for example in U.S. Pat. No. 6,895,207 issued May 17, 2006. A sheet of paper carrying an unfused or powder toner image is passed through the nip. The side of the paper having the unfused or powder toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

Conventional fusing apparatus ordinarily only having single or dual heating elements and thus suffer from lack of precise axial thermal uniformity, particularly in fusing apparatus being required to run at relatively higher and higher throughput speeds, and those using copy sheets or media of various sizes. The problem is even more pronounced in color image fusing apparatus that include fusing members having relatively thicker silicone or rubber outer layers for providing the conformance and dwell time necessary for the increased toner pile heights of color images. In such fusing apparatus, the axial thermal uniformity of the fusing member will get worse as the rubber thickness increases and also as the lengths of jobs vary. In addition, if a paper is run that is more narrow than the heater element, hot spots on the outboard edges are formed resulting in inconsistent fix and gloss.

Examples of conventional fusing apparatus can be found in U.S. Pat. No. 6,895,207 issued May 17, 2006 as mentioned above, and in U.S. Pat. No. 6,407,366 issued Jun. 18, 2002 and entitled "Image heating apparatus having a plurality of heat generating elements". For the purpose of having only a small number of semiconductor switching elements, this reference discloses long heating elements that are treated similar to lamps in that they are multiple long elements parallel to the long axis, and turned on and off like lamps depending on whether the job runs on letter size or legal size sheets.

U.S. Pat. No. 6,734,397 issued May 11, 2004 and entitled "Heater having at least one cycle path resistor and image heating apparatus therein" discloses a heater, or an image heating apparatus including a heater that has a substrate, heat generating resistors formed at least in a cycle path on the substrate, and current supply electrodes provided at electrical ends of the heat generating resistors, wherein plural heat generating resistors are connected in parallel to at least one of the current supply electrodes. Thus there can be obtained a heater having excellent heat generating characteristics even in a compact dimension and an image heating apparatus utilizing such heater.

SUMMARY OF THE DISCLOSURE

In accordance with the present disclosure, there is provided a fusing apparatus having a segmented external heater. The fusing apparatus includes a rotatable pressure roller, a rotatable heated fusing member having an external surface forming a fusing nip with the pressure roller, and a rotatable segmented external heater mounted in heating nip contact with the external surface of the fusing member for heating the external surface of the fusing member, the rotatable segmented external heater having (a) an endless rotatable shell defining an interior surface and an exterior surface, a first end, a second end, and an axis of rotation; (b) a plural number of heating elements each having an end-to-end length and being arranged end-to-end in series and parallel to the axis of rotation; and (c) a controller connected to the plural number of heating elements and to the rotatable heated fusing member controlling the temperature of the external surface the fusing member.

BRIEF DESCRIPTION OF DRAWINGS

In the detailed description below, reference is made to the drawings, in which.

DETAILED DESCRIPTION OF DISCLOSURE

Figure 1:
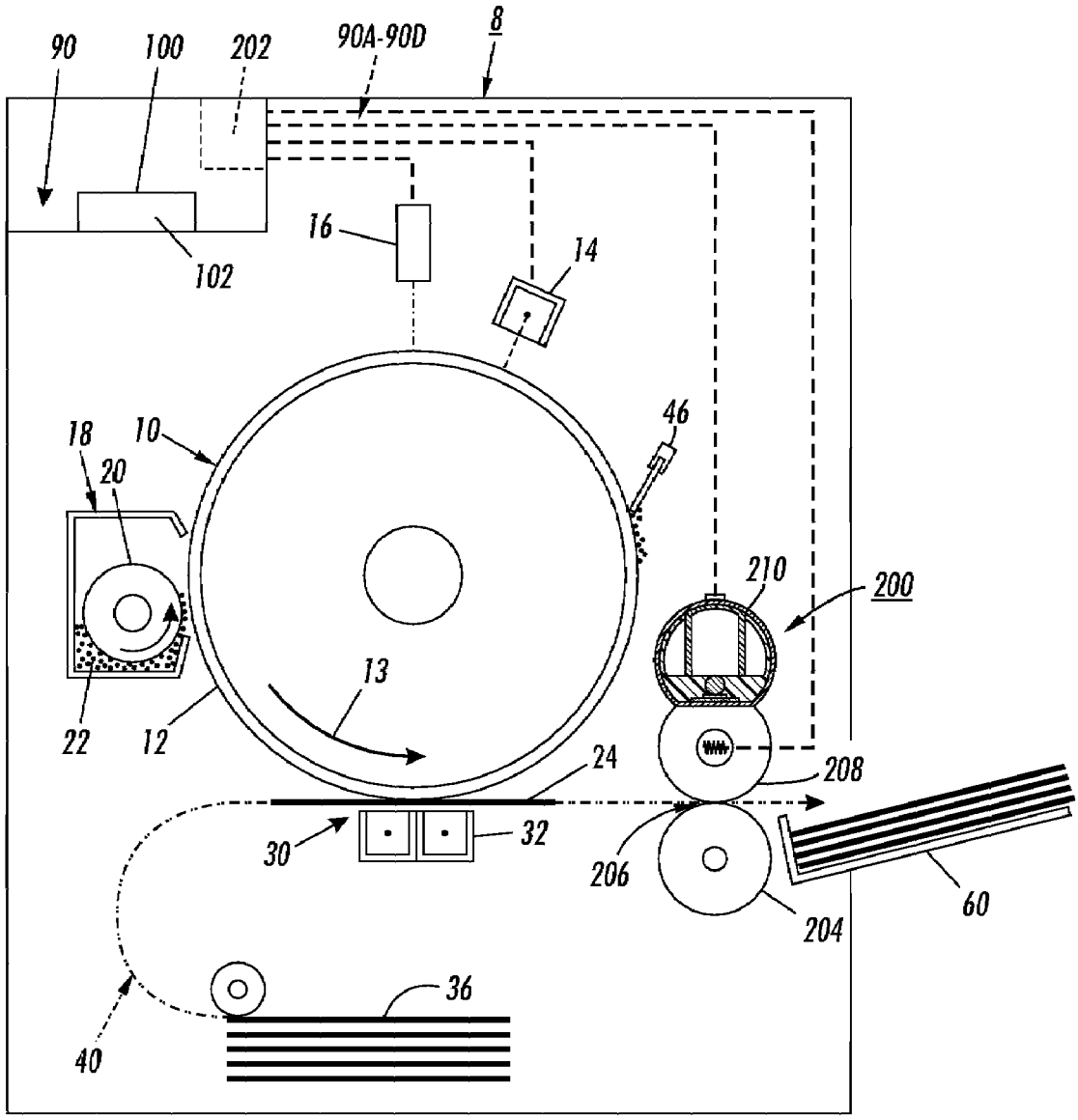
FIG. 1 is an elevational view showing relevant elements of an exemplary toner imaging electrostatographic machine including a first embodiment of the fusing apparatus of the present disclosure.

Referring now to FIG. 1, it is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and image-wise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 34 on which a desired image is to be printed is drawn from a sheet supply stack 36 and conveyed along a sheet path 40 to the transfer zone 30.

At the transfer zone 30, the print sheet 34 is brought into contact or at least proximity with the surface 12 of photoreceptor 10, which at this point is carrying toner particles thereon. A corotron or other charge source 32 at transfer zone 30 causes the toner image on photoreceptor 10 to be electrostatically transferred to the print sheet 34. The print sheet 34 is then forwarded to subsequent stations, as is familiar in the art, including a fusing station having the fusing apparatus 200 of the present disclosure that includes an segmented external heater, and then to an output tray 60. Following such transfer of a toner image from the surface 12 to the print sheet 34, any residual toner particles remaining on the surface 12 are removed by a toner image bearing surface cleaning blade 46 for example.

As further shown, the reproduction machine 8 includes a controller or electronic control subsystem (ESS), indicated generally by reference numeral 90 which is preferably a programmable, self-contained, dedicated mini-computer having a central processor unit (CPU) 202, electronic storage 102, and a display or user interface (UI) 100. The ESS 90, with the help of sensors connections 90A-D, can read, capture, prepare and process image data such as pixel counts of toner images being produced and fused. As such, it is the main control system for components and other subsystems of machine 8 including the fusing apparatus 200 and the segmented external heater of the present disclosure.

Referring now to FIGS. 1-5, the fusing apparatus 200 and the segmented external heater 210 of the present disclosure are illustrated in detail, and are suitable for uniform and quality heating of unfused toner images 213 in the electrostatographic reproducing machine 8.

Figure 2:
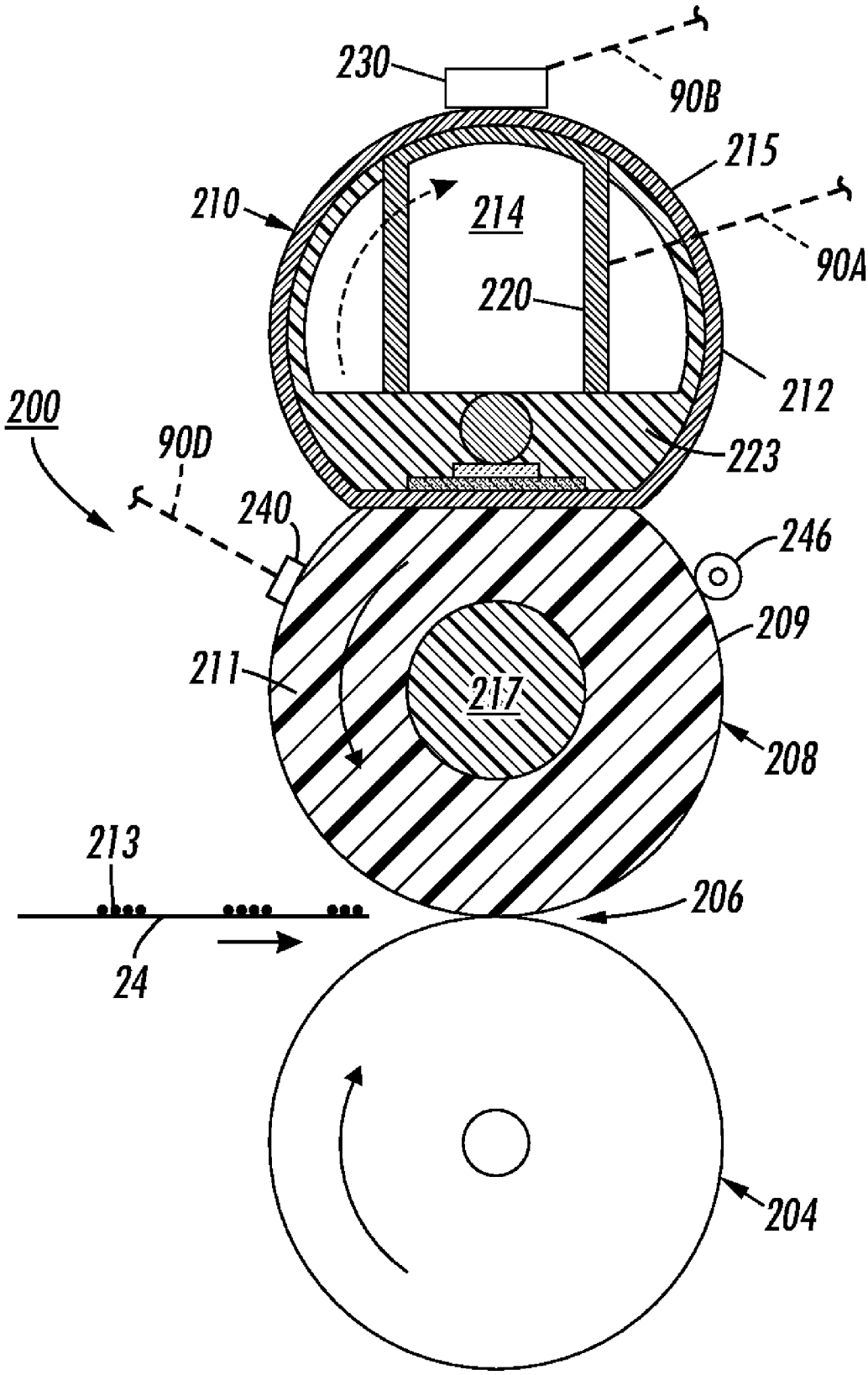
FIG. 2 is an enlarged schematic end view of a second embodiment of the fusing apparatus of FIG. 1.
Figure 3:
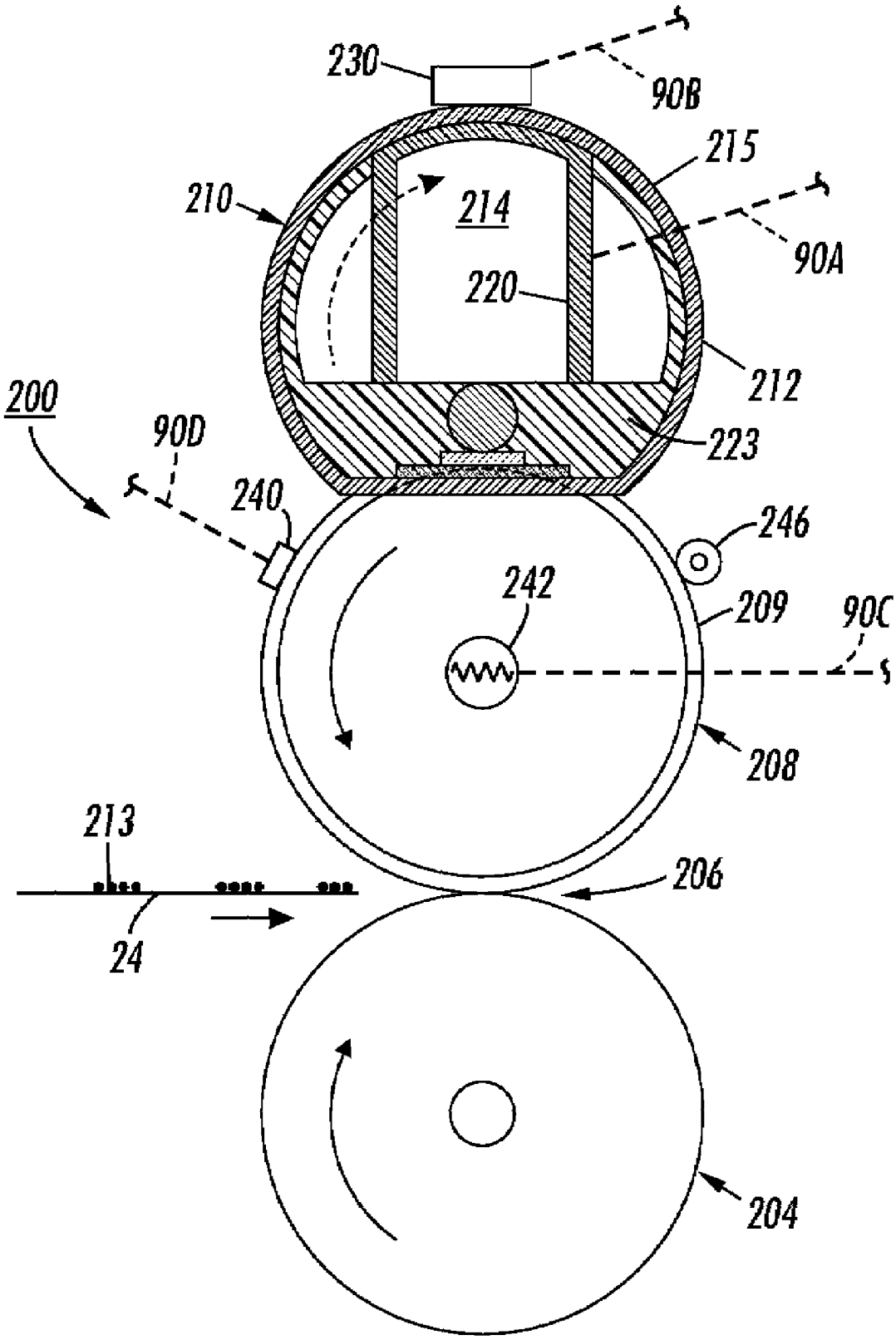
FIG. 3 is an enlarged schematic end view of the first embodiment of the fusing apparatus of FIG. 1.

As illustrated, the fusing apparatus 200 includes a rotatable pressure roller 204 that is mounted forming a fusing nip 206 with a rotatable heated fusing member 208 that is heated externally by the segmented external heater 210 of the present disclosure. A copy sheet 24 carrying an unfused toner image 213 thereon can thus be fed through the fusing nip 206 for high quality fusing. In one embodiment of the fusing apparatus 200 as shown in FIG. 2, the fusing member 208 is a conformable non-hollow rotatable roller including for example at least two layers 211, 217, of which 211 is an outer layer. The outer layer 211 at least is made of a conforming silicone or rubber material. In another embodiment thereof as shown in FIG. 3, the fusing member 208 is a hollow fuser roller including an internal heating element 242 that is connected by a connector 90C to the controller 90.

As further illustrated, the fusing apparatus 200 includes at least a first set of temperature sensors 240 that are mounted in contact with or over the external surface 209 of the fusing member 208 for sensing a temperature of such external surface 209. A cleaning member such as a roller 246 may also be mounted in contact therewith for cleaning such external surface 209. The internal heating element 242 as connected at 90C is controllable as a primary heater for the hollow fuser roller and the plural heating elements 230, connected at 90A to the controller, are thus controllable as auxiliary fine tuning heaters.

Figure 4:
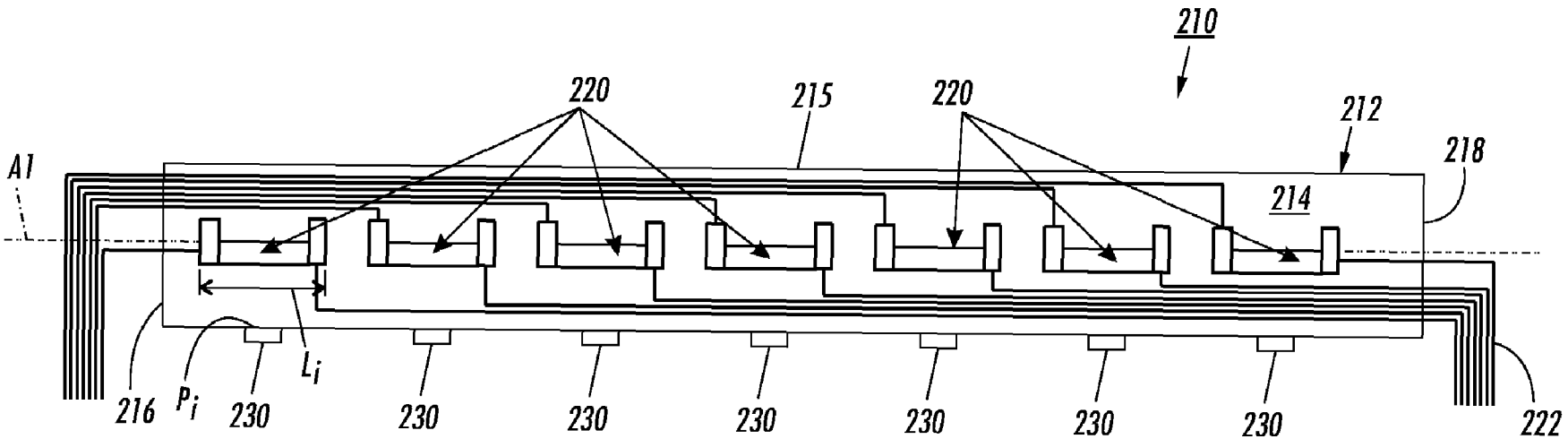
FIG. 4 is an enlarged schematic side view of a first embodiment of the segmented external heater of the present disclosure showing an end-to-end series arrangement thereof in accordance with the present disclosure.
Figure 5:
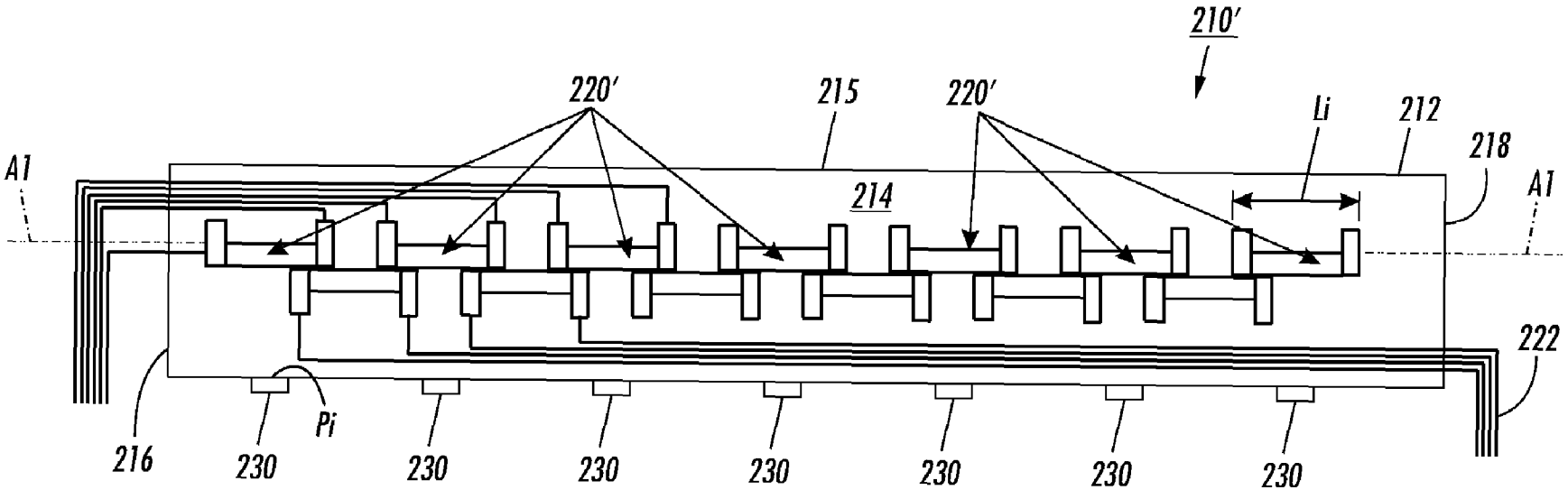
FIG. 5 is an enlarged schematic side view of the segmented external heater of the present disclosure showing an overlapping end-to-end arrangement thereof in accordance with the present disclosure.

Referring still to FIGS. 2-5, the segmented external heater 210, 210' (FIG. 5) of the fusing apparatus 200 of the present disclosure comprises an endless rotatable shell 212 defining an interior 214 and having a first end 216, a second end 218, and an axis A1 for rotation. The segmented external heater 210, 210' also comprises a plural number of heating elements 220, 220' (FIG. 5) that each have an end-to-end length Li and are connected individually by connectors 222 at 90A to the controller 90, and are thus selectively activatable. The plural number of heating elements 220 as shown may be arranged end-to-end in series within the interior 214 as shown in FIG. 4, or 220' in an overlapping manner as shown in FIG. 5, for precisely and tunably heating and controlling the axial temperature at various points of the external surface 209 of the fusing member 208.

As also shown, the segmented external heater 210 of the fusing apparatus 200 of the present disclosure may further include a stationary core 223 within the thin flexible heat conductive belt and a second set of temperature sensors 230 for additionally sensing a temperature of the exterior surface 215 of the rotatable shell 212. The controller 90 as shown is connected by connectors 222 to the plural number of heating elements 220, by connectors 90D to the first set of temperature sensors 240 on the fusing member 208, and to the second set of temperature sensors 230, for precisely sensing and controlling the temperature of the external surface 209 of the fusing member 208. In accordance with an aspect of the present disclosure, the control temperature of the second set of temperature sensors 230 may be set relatively higher than that of the first set of temperature sensors 240.

To recapitulate, the fusing apparatus 200 of the present disclosure includes (a) a rotatable pressure roller 204; (b) a rotatable heated fusing member 208 having an external surface 209 forming a fusing nip 206 with the pressure roller; and (c) a rotatable segmented external heater 210 mounted in heating nip contact with the external surface 209 of the fusing member for heating the external surface of the fusing member. The rotatable segmented external heater has (i) an endless rotatable shell 212 defining an interior 214 and an exterior surface 215, a first end, a second end, and an axis of rotation A1; (ii) a plural number of heating elements 220, 220' each having an end-to-end length and in one embodiment are arranged end-to-end in series and parallel to the axis of rotation; and (iii) a controller 90 connected to the plural number of heating elements and to the fusing member for controlling a temperature of the external surface the fusing member.

The endless rotatable shell 212 comprises a thin flexible heat conductive belt as shown, and the plural number of heating elements 220, 220' comprises at least 4 heating elements that each has equal end-to-end lengths. In another embodiment, the plural number of heating elements within the rotatable shell, are arranged axially in an overlapping end-to-end manner as shown in FIG. 5. In either embodiment, each heating element of the plural number of heating elements is connected separately at 222 to the controller, and is individually and selectably controllable for fine tuning a temperature profile of the fusing member 208.

The fusing member 208 in one case can be a conformable non-hollow fusing roller including two layers 211, 217, and in another case, it can be a hollow fuser roller including an internal heating element 242 connected to the controller 90. The fusing apparatus includes a plural number of temperature sensors 240 mounted over the external surface of the fusing member. Each heating element of the plural number of heating elements each comprises a ceramic heater. The internal heating element 242 is controlled or controllable as a primary heater for the hollow fuser roller and the plural heating elements are controlled as auxiliary fine tuning heaters.

By using segmented ceramic heaters or heating elements 220, 220' and by placing them in an end-to-end arrangement, in the axial direction (A1) within the rotatable shell 212 of the segmented external heater 210, 210', one can selectively activate each segment or heating element 220, 220' by itself, and thus actively control and adjust the temperature profile of individual segments, and hence of the overall fusing member 208.

As can be seen, there has been provided a fusing apparatus having a segmented external heater. The fusing apparatus includes a rotatable pressure roller, a rotatable heated fusing member having an external surface forming a fusing nip with the pressure roller, and a rotatable segmented external heater mounted in heating nip contact with the external surface of the fusing member for heating the external surface of the fusing member, the rotatable segmented external heater having (a) an endless rotatable shell defining an interior surface and an exterior surface, a first end, a second end, and an axis of rotation; (b) a plural number of heating elements each having an end-to-end length and being arranged end-to-end in series and parallel to the axis of rotation; and (c) a controller connected to the plural number of heating elements and to the rotatable heated fusing member controlling the temperature of the external surface the fusing member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A fusing apparatus having a segmented external heater, the fusing apparatus comprising:

(a) a rotatable pressure roller;

(b) a rotatable heated fusing member having an external surface of forming a fusing nip with said pressure roller; and (c) a rotatable segmented external heater mounted in heating nip contact with said external surface of said fusing member for heating said external surface of said fusing member, said rotatable segmented external heater having (i) an endless rotatable shell defining an interior surface and an exterior surface, a first end, a second end, and an axis of rotation; (ii) a plural number of heating elements each having an end-to-end length and being arranged end-to-end in series and parallel to said axis of rotation; and (iii) a controller connected to said plural number of heating elements and to said fusing member for controlling a temperature of said external surface said fusing member.

2. The fusing apparatus of claim 1, wherein said endless rotatable shell comprises a thin flexible heat conductive belt.

3. The fusing apparatus of claim 1, wherein said plural number of heating elements comprise at least 4 heating elements and have equal end-to-end lengths.

4. The fusing apparatus of claim 1, wherein said plural number of heating elements within said rotatable shell are arranged axially in an overlapping end-to-end manner.

5. The fusing apparatus of claim 1, wherein each heating element of said plural number of heating elements is connected separately to said controller, and is individually and selectably controllable for fine tuning a temperature profile of said fusing member.

6. The fusing apparatus of claim 1, wherein said fusing member is a conformable non-hollow fusing roller.

7. The fusing apparatus of claim 1, wherein said fusing member is a hollow fuser roller including an internal heating element connected to said controller.

8. The fusing apparatus of claim 7, wherein said internal heating element is controlled as a primary heater for said hollow fuser roller and said plural heating elements are controlled as auxiliary fine tuning heaters.

9. The fusing apparatus of claim 1, including a plural number of temperature sensors mounted over said external surface of said fusing member.

10. The fusing apparatus of claim 1, wherein each heating element of said plural number of heating elements each comprises a ceramic heater.

11. An electrostatographic reproduction machine comprising:

(a) a moveable imaging member including an imaging surface;

(b) latent imaging means for forming a latent electrostatic toner image on the imaging surface of the moveable imaging member;

(c) a development apparatus mounted adjacent a path of movement of the moveable imaging member for developing the latent electrostatic image on the imaging surface into a toner image;

(d) a transfer station for transferring the toner image from the imaging surface onto an image-carrying substrate; and (e) a fusing apparatus for heating and fusing the toner image, the fusing apparatus having a rotatable pressure roller, a rotatable heated fusing member having an external surface forming a fusing nip with said pressure roller; and a rotatable segmented external heater mounted in heating nip contact with said external surface of said fusing member for heating said external surface of said fusing member, said rotatable segmented external heater having (i) an endless rotatable shell defining an interior surface and an exterior surface, a first end, a second end, and an axis of rotation; (ii) a plural number of heating elements each having an end-to-end length and being arranged end-to-end in series and parallel to said axis of rotation; and (iii) a controller connected to said plural number of heating elements and to said fusing member for controlling a temperature of said external surface of said fusing member.

12. The electrostatographic reproduction machine of claim 11, wherein said plural number of equal end-to-end length heating elements comprise at least 6 heating elements.

13. The electrostatographic reproduction machine of claim 11, wherein each heating element of said plural number of equal end-to-end length heating elements each comprises a ceramic heater.

14. The electrostatographic reproduction machine of claim 11, wherein said endless rotatable shell comprises a thin flexible heat conductive belt.

15. The electrostatographic reproduction machine of claim 14, including a stationary core within said thin flexible heat conductive belt.

16. The electrostatographic reproduction machine of claim 11, wherein said plural number of heating elements within said rotatable shell are arranged axially in an overlapping end-to-end manner.

17. The electrostatographic reproduction machine of claim 11, wherein each heating element of said plural number of heating elements is connected separately to said controller, and is individually and selectably controllable for fine tuning a temperature profile of said fusing member.

18. The electrostatographic reproduction machine of claim 11, wherein said fusing member is a hollow fuser roller including an internal heating element connected to said controller.

19. The electrostatographic reproduction machine of claim 18, wherein said internal heating element is controlled as a primary heater for said hollow fuser roller and said plural heating elements are controlled as auxiliary fine tuning heaters.

20. The electrostatographic reproduction machine of claim 11, including a plural number of temperature sensors mounted over said external surface of said fusing member.

* * * * *